US010278512B2

(12) United States Patent
Stjerna

(10) Patent No.: US 10,278,512 B2
(45) Date of Patent: May 7, 2019

(54) BED WITH AUTOMATICALLY ADJUSTABLE PROPERTIES

(71) Applicant: Stjernfjädrar AB, Herrljunga (SE)

(72) Inventor: Nils Eric Stjerna, Herrljunga (SE)

(73) Assignee: STARSPRINGS AB, Herrljunga (SE)

( * ) Notice: Subject to any disclaimer, the term of this patent is extended or adjusted under 35 U.S.C. 154(b) by 504 days.

(21) Appl. No.: 14/649,257

(22) PCT Filed: Dec. 12, 2013

(86) PCT No.: PCT/EP2013/076330
§ 371 (c)(1),
(2) Date: Jun. 3, 2015

(87) PCT Pub. No.: WO2014/095552
PCT Pub. Date: Jun. 26, 2014

(65) Prior Publication Data

US 2016/0015183 A1 Jan. 21, 2016

(30) Foreign Application Priority Data

Dec. 19, 2012 (EP) ..... 12198078

(51) Int. Cl.
*A47C 27/06* (2006.01)
*A47C 31/12* (2006.01)
(Continued)

(52) U.S. Cl.
CPC ..... *A47C 27/061* (2013.01); *A47C 23/0435* (2013.01); *A47C 27/064* (2013.01);
(Continued)

(58) Field of Classification Search
CPC ... A47C 27/061; A47C 27/083; A47C 27/082; A47C 23/0435; A47C 27/06; A47C 31/123
See application file for complete search history.

(56) References Cited

U.S. PATENT DOCUMENTS 3,340,548 A 9/1967 Janapol
4,222,137 A 9/1980 Usami
(Continued)

FOREIGN PATENT DOCUMENTS

AU 551300 B2 4/1986
EP 2245967 A1 11/2010
(Continued)

OTHER PUBLICATIONS

International Search Report PCT/ISA/210 for International Application No. PCT/EP2013/076330 dated Mar. 3, 2014.
(Continued)

*Primary Examiner* — Eric J Kurilla
(74) *Attorney, Agent, or Firm* — Harness, Dickey & Pierce, P.L.C.

(57) ABSTRACT

A bed arrangement including adaptive properties is disclosed. The bed arrangement includes a mattress including at least one zone including independently adjustable firmness and/or height, a drive unit arranged to adjust the firmness and/or height of the at least one zone and at least one sensor. The sensor(s) is adapted to measure a physical parameter which is relatable to a lying position used by a user. Further, a control unit is arranged to determine, based on input from the sensor(s), the present lying position of a user. The lying position is determinable to be one of a set of at least two predefined lying positions. Further, the control unit controls the drive unit to adjust the firmness and/or height of the zone(s) to preset firmness/height value(s) corresponding to the determined lying position. Hereby, an automatic adaption of the bed properties to various lying positions is obtained.

19 Claims, 7 Drawing Sheets

(51) Int. Cl.
*A47C 23/04* (2006.01)
*A47C 23/043* (2006.01)
*A47C 27/08* (2006.01)

(52) U.S. Cl.
CPC ..... *A47C 27/082* (2013.01); *A47C 27/083* (2013.01); *A47C 31/123* (2013.01)

(56) References Cited

U.S. PATENT DOCUMENTS

| | | | | |
|---|---|---|---|---|
| 4,667,357 | A | 5/1987 | Fortune | |
| 5,113,539 | A | 5/1992 | Strell | |
| 6,115,861 | A | 9/2000 | Reeder et al. | |
| 6,460,209 | B1 | 10/2002 | Reeder et al. | |
| 8,161,826 | B1 | 4/2012 | Taylor | |
| 2002/0178503 | A1 | 12/2002 | Reeder et al. | |
| 2003/0221261 | A1 | 12/2003 | Torbet et al. | |
| 2004/0133987 | A1 | 7/2004 | Reeder et al. | |
| 2004/0177449 | A1 | 9/2004 | Wong et al. | |
| 2006/0253994 | A1 | 11/2006 | Spinks et al. | |
| 2008/0052837 | A1* | 3/2008 | Blumberg ..... | A47C 23/002 5/727 |
| 2010/0317930 | A1* | 12/2010 | Oexman ..... | A47C 31/123 600/300 |
| 2011/0258772 | A1 | 10/2011 | Verschuere et al. | |
| 2011/0314612 | A1* | 12/2011 | Hsu ..... | A47C 27/082 5/710 |
| 2012/0311790 | A1* | 12/2012 | Nomura ..... | A61G 7/05776 5/710 |
| 2013/0000047 | A1* | 1/2013 | McCann ..... | A47C 27/082 5/709 |

FOREIGN PATENT DOCUMENTS

| | | | |
|---|---|---|---|
| JP | 2002360387 | A | 12/2002 |
| RU | 2463936 | C2 | 10/2012 |
| WO | WO-9918827 | A1 | 4/1999 |
| WO | WO-9965366 | A1 | 12/1999 |
| WO | WO-04080246 | A1 | 9/2004 |
| WO | WO-2009120270 | A2 | 10/2009 |
| WO | WO-12012892 | A1 | 2/2012 |

OTHER PUBLICATIONS

Russian Office Action and Search Report along with an English translation thereof dated Sep. 14, 2017.
European Office Action dated Oct. 9, 2017.

* cited by examiner

BED WITH AUTOMATICALLY ADJUSTABLE PROPERTIES

FIELD OF THE INVENTION

The present invention relates to a bed arrangement having zones with independently and automatically adjustable firmness and/or height.

BACKGROUND OF THE INVENTION

In a bed arrangement, a support is provided to act on the weight or part of the weight of a user, wherein the bed distributes the weight from the body of the user over a part of a surface of the device. Depending on how the bed distributes the weight of the user, the bed will appear as being either soft or firm. The degree of firmness of such a bed is dependent on the properties of the elastic elements, such as the spring constant, and how the elastic members have been mounted in the bed, such as the degree of clamping or pre-tensioning. Thus, the firmness of the bed is normally set at the manufacturing of the device.

However, different persons wish and require different firmness. Further, different body parts may require different firmness.

It is known to provide bed arrangements with variable firmness. By inducing deformation to the elastic members to different degrees, the firmness of the device is adjustable. The deformation member has the ability to deform the elastic member independently from the deformation of the elastic member induced by the being. This means that the firmness of the bed is adjustable during initialization, according to the wishes of the user. It is also possible to compensate the firmness of the device for possible changes in the elastic properties of the elastic arrangement over time. Still further, it is known to vary the firmness independently in various zones/sections in a mattress.

Such known solutions are e.g. disclosed in EP 2 245 967 and WO 2009/120270. Both these documents also discloses the possibility of sensing the pressure being applied on different zones, and to control the firmness of different zones automatically, in order to lower the overall pressure.

However, what firmness of the various zones that is experienced as being most comfortable varies significantly from user to user. Thus, an overall minimization of the pressure will for many users not provide the most comfortable setting. Further, the pressure distribution being applied to a mattress varies significantly depending on the lying position of the user, and a user will often tend to request both different firmness distributions between the zones and different overall firmness/softness of the mattress in different lying positions.

It is therefore still a need for a bed arrangement which may automatically adjust the firmness in order to provide a more comfortable bed, and thereby to provide a more relaxing and healthy rest and sleep, and in a relatively cost-efficient way.

SUMMARY OF THE INVENTION

It is therefore an object of the present invention to at least partly overcome these problems, and to provide an improved bed arrangement.

These, and other objects that will be apparent from the following, are achieved by a bed arrangement, and a method for controlling such a bed arrangement, according to the appended claims.

According to a first aspect of the invention there is provided a bed arrangement having adaptive properties, comprising:

a mattress comprising at least one zone having independently adjustable firmness and/or height;

a drive unit arranged to adjust the firmness and/or height of said at least one zone;

at least one sensor, said sensor(s) being adapted to measure a physical parameter which is relatable to a lying position used by a user; and a control unit arranged to determine, based on input from said sensor(s), the present lying position of a user, said lying position being determinable to be one of a set of at least two predefined lying positions, and to control the drive unit to adjust the firmness and/or height of said zone(s) to preset firmness/height values corresponding to the determined lying position.

The sleeping experience, and what is considered comfortable and not, varies greatly from person to person. Further, a user often may find it more comfortable to have a softer mattress when using one lying position, such as on the stomach, i.e in a prone position, or on the side, than when resting in other sleeping positions, such as on the back, i.e. in supine position. The present invention provides an efficient, yet relatively simple and cost-efficient, way of varying the mattress properties in dependence of the user's choice of lying position, thereby at all times providing the best possible comfort. It has been found that this greatly improves the sleeping and resting experience, which provides better resting and sleeping quality. Improved sleep and rest also improves the health of the user, and overall leads to an improved quality of life.

In the context of the present application, "bed arrangement" is to be construed broadly. The bed arrangement may be contained in a single unit, but may also be arranged as a more or less distributed system. For example, the control unit (wholly or partly), the sensor, optional remote control(s) etc may be arranged as separate units, being connected to other parts of the bed arrangement by wired or wireless connections.

The sensor(s) may be attached to, or integrated in, the mattress. However, the sensor(s) may also be connected to a bed frame or the like. Still further, the sensor(s) may be arranged as a separate unit, e.g. to be worn by the user of the bed arrangement.

Preferably, at least one sensor is arranged in each of the zones. However, depending on e.g. the sensor type used it is also possible to determine a lying position by sensors arranged solely in one or a few of the zones, or sensors arranged outside the zones, e.g. at an end section of the bed arrangement.

The mattress preferably comprises at least two zones having independently adjustable firmness and/or height. However, even more preferably it comprises at least three such zones, and preferably at least five zones. For example, different zones with variable firmness may be provided at least for the user's hip part and shoulder part. Such zones may be provided also for the user's feet part and head part. In between these zones, zones being provided with a constant firmness/height may be provided. However, alternatively also these zones may have a variable firmness and/or height. Thus, in more refined embodiments, 7, 10 or even more zones with variable firmness/height may be provided.

Preferably, the zones having independently adjustable firmness and/or height extends over essentially the whole width of the mattress, and the zones being separated in a longitudinal direction of the mattress. Since the same firmness is usually requested, regardless of the whether the user lies in the centre, or towards one of the sides, there is usually no need to separate the zones in the width direction. However, in case the bed arrangement is to be used by more than one person simultaneously, or if there is a need to distinguish between different lateral positions for other reasons, zones having variable firmness/height being separated also in the width direction may be used.

The set of predefined lying positions preferably comprises at least two, and preferably three lying positions corresponding to the user lying on the back (supine position), on the stomach (prone position) and on the side. However, more than three lying positions may also be defined. For example, different side lying positions may be defined, such as lying with the body straight or bent/curled forward or backward.

The sensor(s) for determining lying position may be of various types, and arranged to determine various physical parameters relatable to the lying position. For example, the sensor(s) may be arranged to determine the weight acting on the mattress by the user in various measurement areas, by measuring the deformation in the mattress caused by the user, by measuring the relative air humidity at different positions, by measuring the temperature locally at different positions, or the like. The lying position may also be determinable by automated visual inspection, by means of a camera, IR sensor or the like.

The sensor(s) may also be arranged on the body of the user, such as being directly attached to the user by means of plaster, adhesive, tape or the like, or being attached to nightclothes, pyjamas or the like being worn by the user. In such cases, the sensor(s) may be arranged to detect absolute position, movements, etc. For example, the sensor(s) may be an accelerometer, such as the ones used in smart phones and the like, preferably measuring acceleration in multiple directions, such as along three different axes. Alternatively or additionally, the sensor(s) may comprise a gyroscopic sensor, such as a MEMs (micro-electro-mechanical-systems) gyroscope or an optical gyroscope, such as is currently used in a wireless mouse and the like. By combining a gyroscope with an accelerometer, the sensors may sense motion on even more axes, such as left, right, up, down, forward and backward, as well as roll, pitch and yaw rotations, allowing for more accurate motion sensing abilities. However, other types of wearable sensors may be used, such as magnetometer compasses, and the like.

The wearable sensor(s) may be positioned on various positions on the body. A preferred location is on top of one of the shoulders, i.e. being worn as an epaulet. This position is highly useable to determine a lying position, and is also normally not in contact with the bed or the bedclothes during the rest. The sensor(s) preferably communicate with the control unit by wireless communication, through an RFID interface, Bluetooth, or the like.

Alternatively, the sensors may be arranged as an array of sensors being arranged over the mattress surface. For example, the sensors may be arranged in a preferably flexible and planar sensor envelope arranged on top of the mattress. The sensor envelope may have an electrical impedance, and in particular resistance, characteristic that varies with a normal force exerted thereon. In particular, the sensor envelope may include an upper flexible electrically conductive sheet comprising an upper sensor conductor, a lower flexible electrically conductive sheet comprising a lower sensor conductor, and a flexible intermediate layer, such as a piezoresistive layer, having an active sensor region which has an electrical impedance characteristic that varies with a normal force exerted thereon, said intermediate layer being located between said upper and lower conductive sheets. The upper and lower sheets are here conductively coupled to the intermediate layer. The sensors may preferably have a non-bilateral current-versus-voltage impedance characteristics. The piezoresistive layer is e.g. realizable as electrically conductive particles suspended in a polymer matrix. The electrically conductive particles may e.g. be provided with a coating including at least one metallic oxide, such as copper oxide, to thereby form with said layer a semi-conducting PN-junction. The envelope is preferably made, at least partially, of an elastically stretchable material, and preferably by stretchable fabric. Examples of such sensor envelopes that may be used in the above-discussed bed arrangement are the ones disclosed in U.S. Pat. No. 8,161,826 and WO 2009/120270, both said documents hereby being incorporated by reference.

The different lying positions and/or the different firmness/height of the variable zones may be predefined, or be defined and set once and for all during manufacture, or during an initialization performed e.g. at the vendor. However, preferably at least one of the set of lying positions and the firmness/height parameters are user definable, and also possible to redefine and reset over time.

To this end, the control unit is preferably operable in a parameter setting mode, in which the preset firmness/height values for the different zones in the different lying positions are definable and/or adjustable. It is also preferred that, in the parameter setting mode, the set of predefined lying positions is definable and/or re-definable.

Hereby, the user may enter the parameter setting mode whenever he/she so wishes, and in the parameter setting mode adjust the firmness/height values for different zones for different lying positions, define new lying positions, or cancel previously defined lying positions. This may e.g. be done by the user lying on the bed, and assuming any certain lying position. He/she may then adjust the firmness/height manually in the different zones until a comfortable setting has been obtained. The lying position and firmness/height values for the different zones may then be stored. This may be repeated for other lying positions. Alternatively or additionally, a previously stored lying position may be retrieved, and the firmness/height values of the different zones be adjusted, and then stored.

For communication with the control unit, a remote control may be used, which is adapted to communicate with the control unit, e.g. through a wireless interface.

The control unit may further be arranged to store, when the set of lying positions is defined or redefined, sensor data from the sensors corresponding to the predefined lying positions, and to use the stored data for distinguishing between the predefined lying positions when in an operative mode. It has been found by the present inventors that the measured data from a set of different sensors may be used to uniquely identify a large number of different lying positions, either by using the magnitude of the individual measured values, and/or by considering the relationship(s) between simultaneously measured values. This may be used to predefine how different lying positions should be identified in general, regardless of the specific user. However, since user of considerable different weight, height and body shape may use the bed arrangement, it is preferred to define these values and/or relationship(s) individually for each user.

The control unit may be arranged to determine, based on input from said sensors, the present lying position of a user continuously or regularly. For example, the control unit may continuously monitor the sensor data, and evaluate whether a change in lying position has occurred, or do such evaluation regularly, such as every 15 or 30 seconds, every minute, or the like. However, alternatively or additionally, the control unit may be adapted to determine, based on input from said sensors, the present lying position of a user when it is determined that a sensor input from any of the sensors is changed compared to a last stored sensor value from said sensor by a magnitude exceeding a predefined threshold value.

The mattress may be of various types, such as comprising inflatable elements, resilient foam elements, resilient rubber, water filled elements, and the like. However, preferably the mattress comprises a plurality of coil springs, and preferably coil springs arranged in separate pockets of a cover material, to define a pocket spring mattress.

According to another aspect of the invention, there is provided a method for automatic adaptation of the properties of a bed arrangement, comprising the steps:

providing a mattress comprising at least one zone having independently adjustable firmness and/or height;

providing at least one sensor, said sensor(s) being adapted to measure a physical parameter relatable to a lying position used by a user;

determining, based on input from said sensor(s), the present lying position of the user, said lying position being determinable to be one of a set of at least two predefined lying positions; and adjusting the firmness and/or height of said at least one zone to preset firmness/height values corresponding to the determined lying position.

By means of these additional aspects of the invention, similar objects and advantages as discussed above in relation to the first aspect of the invention are obtainable.

BRIEF DESCRIPTION OF THE DRAWINGS

These and other aspects of the present invention will now be described in more detail, with reference to the appended drawings showing currently preferred embodiments of the invention.

DETAILED DESCRIPTION

Figure 1:
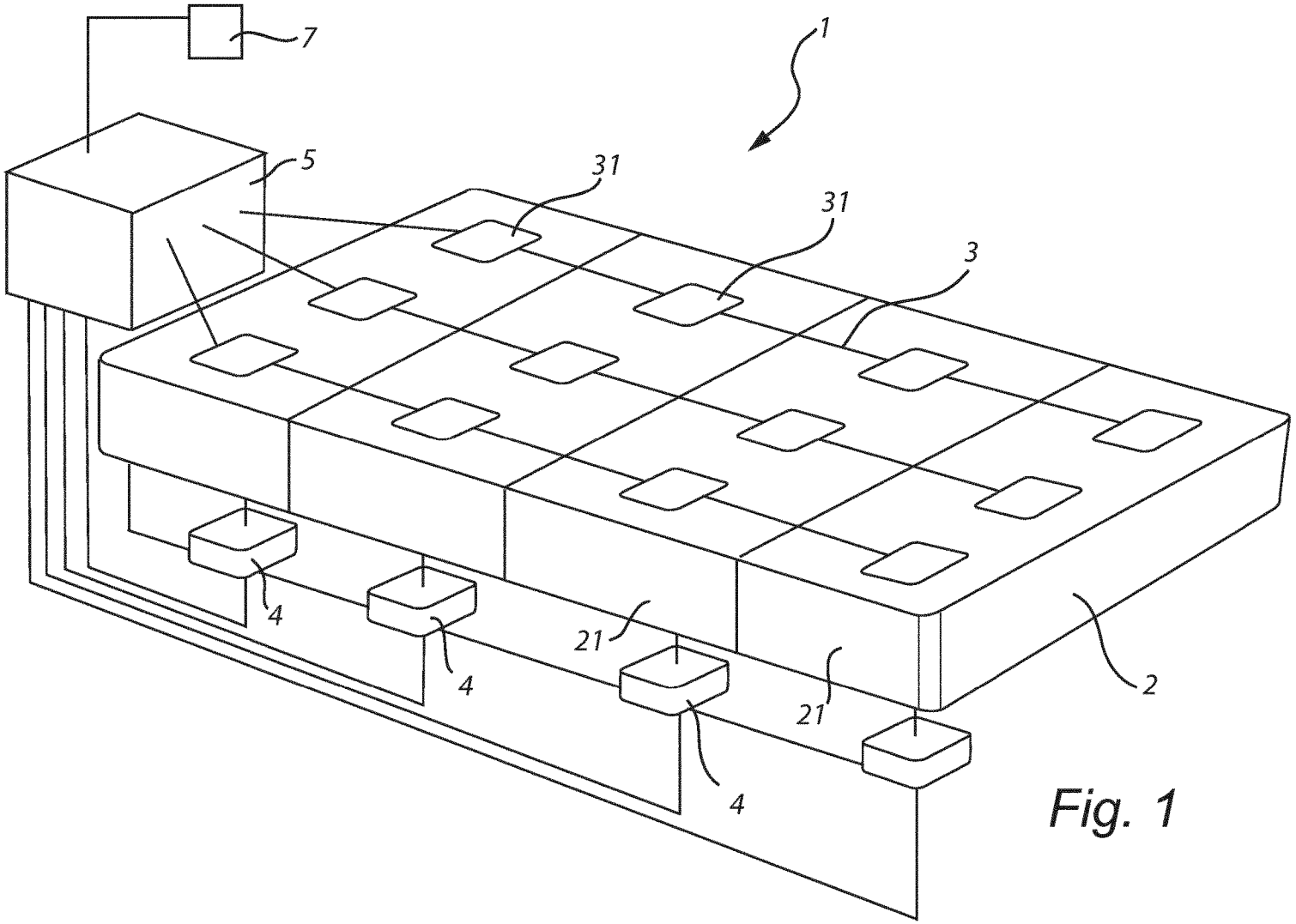
FIG. 1 shows a schematic perspective side view of an embodiment of a bed arrangement according to the present invention.

A bed arrangement according to a first embodiment of the invention is shown schematically in FIG. 1. The bed arrangement has adaptive properties, and more specifically comprises at least one, and preferably at least two, zones having independently adjustable firmness and/or height.

The bed arrangement 1 comprises a mattress 2, having a plurality of zones 21. Further, a sensor arrangement 3 is provided, having at least one sensor 31 arranged on each of the zones. The sensors are adapted to measure a physical parameter which is proportional to a weight acting on the mattress by the user in measurement areas of the sensors. Further, there is provided at least one drive unit 4 arranged to adjust the firmness and/or height of the zones. A control unit 5 is arranged to receive input from the sensors, and determine, based on this input, the present lying position of a user. The lying position is determined to be one of a set of at least two predefined lying positions. Further, the control unit 5 is arranged to control the drive unit(s) to adjust the firmness and/or height of the zones to preset firmness/height values corresponding to the determined lying position.

The mattress comprises at least two zones having independently adjustable firmness and/or height. However, preferably it comprises at least three such zones, and preferably at least five zones. For example, different zones with variable firmness/height may be provided at least for the user's buttock and shoulder. Such zones may be provided also for the user's feet and head. In between these zones, zones being provided with a constant firmness/height may be provided. However, alternatively also these zones may have a variable firmness and/or height. Thus, in more refined embodiments, 7, 10 or even more zones with variable firmness/height may be provided.

Figure 2A:
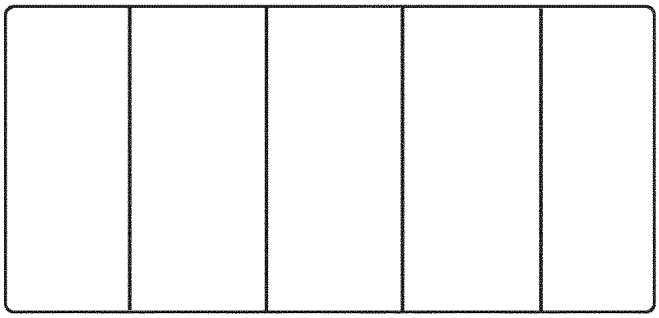
FIGS. 2*a*-2*d* show schematic top views of mattresses to be used in the bed arrangement of FIG. 1 and having different zone configurations.

In FIG. 2*a*, an exemplary embodiment having five zones with variable firmness and/or height is illustrated. The zones may in this case correspond to head/neck, shoulders, pelvis, legs and feet (from one side to the other).

Figure 2B:
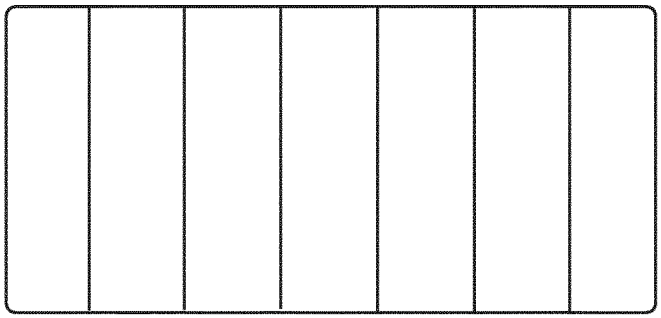

In FIG. 2*b*, an exemplary embodiment having seven zones with variable firmness and/or height is illustrated. The zones may in this case correspond to head/neck, shoulder/upper back, lumbar, buttock/pelvis, thigh/knee, calf/lower leg and foot/ankle (from one side to the other).

Figure 2C:
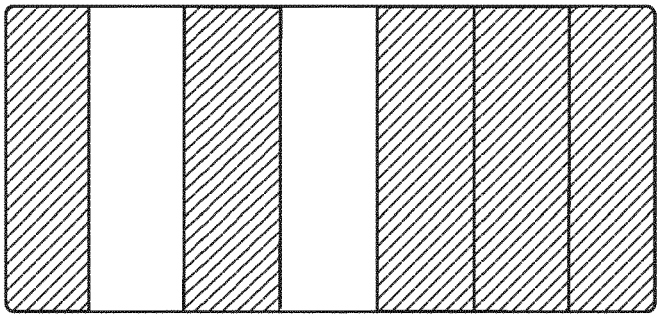

In FIG. 2*c*, the same zones as in FIG. 2*b* are provided, but here, only the shoulder/upper back zone and the buttock/pelvis zone have adjustable firmness and/or height, whereas the other zones are provided with a fixed firmness/height. The thigh/knee, calf/lower leg and foot/ankle zones may in this case be provided as three separate zones, as two zones or as one single zone.

However, the above-discussed zone configurations are only provided as examples, and other zone configurations, involve more or fewer zones are also feasible.

Figure 2D:
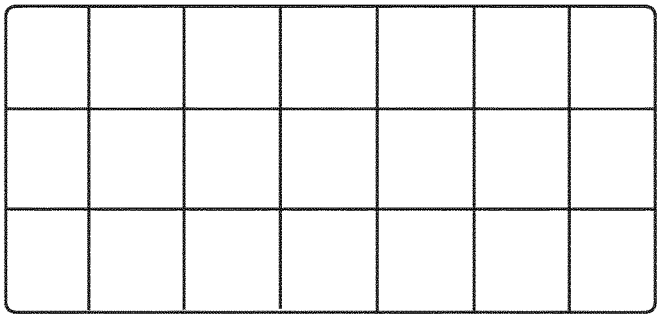

Preferably, the zones having independently adjustable firmness and/or height extends over essentially the whole width of the mattress and being separated in a longitudinal direction of the mattress. Such embodiments are illustrated in FIGS. 2*a*, 2*b* and 2*c*. However, in case the bed arrangement is to be used by more than one person simultaneously, or if there is a need to distinguish between different lateral positions for other reasons, zones having variable firmness/height being separated also in the width direction may be used. An example of such a zone configuration is illustrated in FIG. 2*d*. Here, seven zones in the longitudinal direction are provided, as in FIG. 2*b*, but in addition each longitudinal zone is also separated into three zones in the width direction. Thus, in total this embodiment comprises 21 zones having independently controllable firmness and/or height. Again, the above-discussed zone configuration is only provided as an example, and a separation in two zones in the width direction is equally feasible, as well as more than three, such as four, five or even more.

Figure 3A:
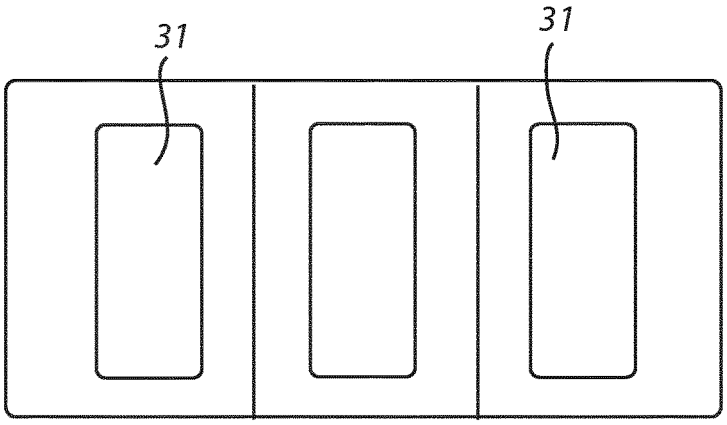
FIGS. 3*a*-3*c* show schematic top views of different embodiments of sensor arrangements on the mattress in the bed arrangement of FIG. 1.
Figure 3B:
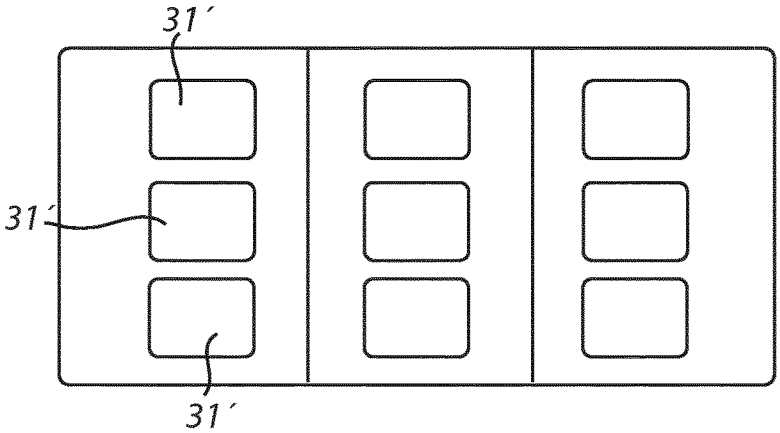
Figure 3C:
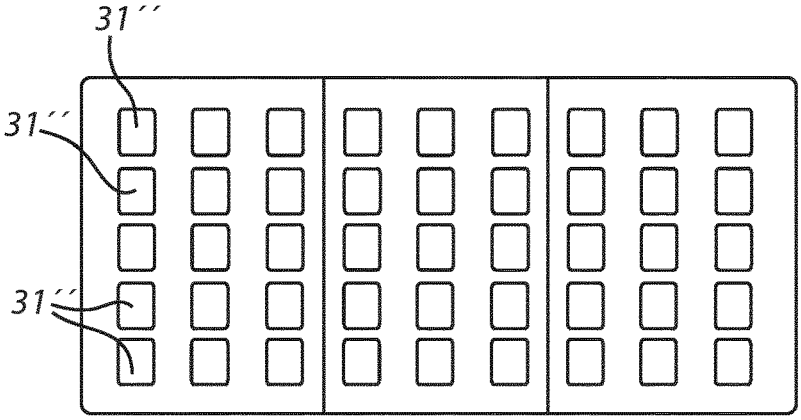

The sensors are preferably arranged on top of the mattress. Various configuration arrangements are feasible, depending on which type of sensors that are used, and how fine resolution that is required. In FIGS. 3*a*-3*c*, some alternative configurations are schematically illustrated.

In FIG. 3*a*, a sensor arrangement providing one sensor area 31 in each zone is illustrated. Hereby, the pressure being applied on each zone is determinable. In FIG. 3*b*, a sensor arrangement providing three sensor areas 31' in each zone is illustrated, the sensor areas being separated in a width direction of the mattress. Hereby, the pressure being applied on each zone is determinable, but in addition, it is possible to determine how the pressure on each zone is distributed between the centre and the sides. In FIG. 3*c* the sensor arrangement comprises an array of sensors areas 31" within each zone, the sensors within each zone being separated both in the length and width direction of the mattress. In the exemplary embodiment of FIG. 3*c*, 5 sensor areas are provided in the length direction, and three sensor areas in the width direction in each zone, providing a total of 15 sensor areas within each zone. However, more or fewer sensor areas may be used, and the sensor areas may also be arranged in different patterns. The number of sensor areas also need not be the same in all the different zones.

The sensors are adapted to measure a physical parameter relateable to the lying position being used by the user, such as a physical parameter being proportional to a weight acting on the mattress by the user, or being related to relative air humidity, temperature or the like. Measured information regarding the physical parameter is transferred to the control unit. The physical parameter may e.g. be pressure, weight, deformation, temperature, air humidity, etc. Thus, by means of the sensor, the weight subjected to the bedding arrangement is measurable, or other variations occurring due to a change of lying position. The measured information is used as a basis for adjusting the firmness and/or height of the zones, as will be discussed in more detail in the following.

Many different gauges may be used for realization of the sensors. For example, one or several of manometers, piezoelectric strain gauges, capacitive gauges, magnetic gauges, piezoelectric gauges, optical gauges, potentiometric gauges and resonant gauges, thermocouple gauges and thermistor gauges may be used. The sensors may be arranged within the mattress, below the mattress or on top of the mattress.

Figure 4:
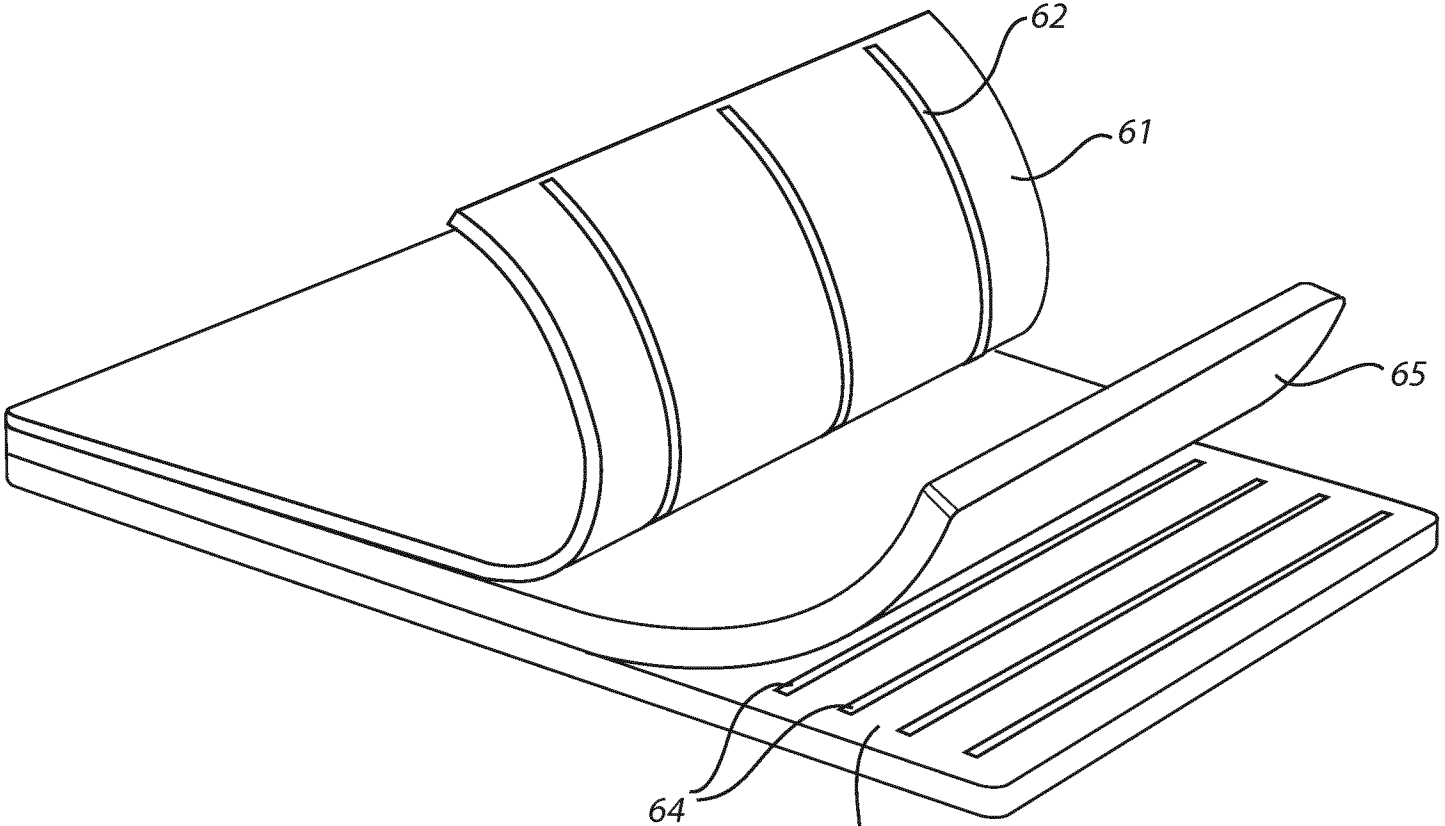
FIG. 4 shows schematically a more detailed view of one embodiment of sensor arrangement.

In an exemplary embodiment, the sensors are realized as an array of sensors being arranged over the mattress surface. For example, the sensors may be arranged in a preferably flexible and planar sensor envelope arranged on top of the mattress. The sensor envelope may have an electrical impedance characteristic that varies with a normal force exerted thereon. Such an sensor arrangement is shown schematically in FIG. 4. Here, the sensor envelope includes an upper flexible electrically conductive sheet 61 comprising upper sensor conductor(s) 62, a lower flexible electrically conductive sheet 63 comprising lower sensor conductor(s) 64, and a flexible intermediate layer 65, such as a piezoresistive layer, having an active sensor region which has an electrical impedance characteristic that varies with a normal force exerted thereon. The intermediate layer 65 is located between the upper conductive sheet 61 and the lower conductive sheet 63. The upper and lower sheets 61, 63 are here conductively coupled to the intermediate layer. The sensors may preferably have a non-bilateral current-versus-voltage impedance characteristics. The piezoresistive layer is e.g. realizable as electrically conductive particles suspended in a polymer matrix. The electrically conductive particles may e.g. be provided with a coating including at least one metallic oxide, such as copper oxide, to thereby form with said layer a semi-conducting PN-junction. The envelope is preferably made, at least partially, of an elastically stretchable material, and preferably by stretchable fabric. Examples of such sensor envelopes that may be used in the above-discussed bed arrangement are the ones disclosed in U.S. Pat. No. 8,161,826 and WO 2009/120270, both said documents hereby being incorporated by reference.

Based on the information received from the sensors, the control unit 5 is arranged to determine which one, of a set of predetermined lying positions, the user is currently in. The set of predefined lying positions preferably comprises at least two, and preferably three lying positions corresponding to the user lying on the back (supine position), on the stomach (prone position) and on the side. However, more than three lying positions may also be defined. For example, different side lying positions (e.g. lateral recumbent position) may be defined, such as lying with the body straight or bent/curled forward or backward. It may also be possible and requested to distinguish between a left side position (such as left lateral recumbent position) and a right side position (e.g. right lateral recumbent position). Further, it is possible to distinguish between different arm positions in the prone, supine and side positions. E.g. it may be distinguished whether the arms are arranged along the body, outwards from the body, upwards from the body and/or arranged underneath the head.

Some studies indicate that the most commonly used lying positions during sleep are:

- foetal position, i.e. a pronouncedly bent/curled side position (41%);
- "trunk" position, i.e. a straight side position with the arms along the body (15%);
- "nostalgic" or "yearner" position, i.e. a slightly bent/curled side position, with the arms directed laterally forward in the same direction, and away from the body (13%);
- "soldier" position, i.e. a supine position, with the arms along the body (8%);
- "free fall" position, i.e. a prone position, with the arms directed upwards along the sides of the head (7%); and
- "starfish" position, i.e. a supine position with the arms directed upwards, along the sides of the head (5%).

These and possibly further lying positions may preferably be identifiable by the control unit.

The different lying positions and/or the different firmness/height of the variable zones may be predefined, or be defined and set once and for all during manufacture, or during an initialization performed e.g. at the vendor. However, preferably at least one of the set of lying positions and the firmness/height parameters are user definable, and also possible to redefine and reset over time.

To this end, the control unit is preferably operable in a parameter setting mode, in which the preset firmness/height values for the different zones in the different lying positions are definable and/or adjustable. It is also preferred that, in the parameter setting mode, the set of predefined lying positions is definable and/or re-definable.

Hereby, the user may enter the parameter setting mode whenever he/she so wishes, and in the parameter setting mode adjust the firmness/height values for different zones for different lying positions, define new lying positions, and/or cancel previously defined lying positions. This may e.g. be done by the user lying on the bed, and assuming any certain lying position. He/she may then adjust the firmness and/or height manually in the different zones until a comfortable setting has been obtained. The lying position and firmness/height values for the different zones may then be stored. This may be repeated for other lying positions. Alternatively or additionally, a previously stored lying position may be retrieved, and the firmness/height values of the different zones be adjusted, and then stored.

For communication with the control unit, a remote control 7 may be used, which is adapted to communicate with the control unit, e.g. through a wireless interface.

The control unit may further be arranged to store, when the set of lying positions is defined or redefined, sensor data from the sensors corresponding to the predefined lying positions, and to use the stored data for distinguishing between the predefined lying positions when in an operative mode. This can be achieved by means of predefined data how different lying positions should be identified in general, regardless of the specific user. However, since user of considerable different weight, height and body shape may use the bed arrangement, it is preferred to define these values and/or relationship(s) individually for each user.

Allowing the user to define by him/herself the various lying positions to be recognized by the control unit and to set the desired firmness/height of the zones for each of said lying positions is a relatively simple and straightforward way of setting up the operation of the control unit. The user will typically be quite aware of which lying positions that he/she uses most frequently. The user will then, as an example, first assume a first of these lying positions, and set the desired firmness/height levels of each zone by means of e.g. a remote control. When the user is content with the result, he will store the setting by activation of a suitable control on the remote control. Hereby, the control unit will store this as a first lying position, together with the firmness/height levels of each of the zones for said lying position, and together with the data of the sensors obtained when the user was assuming this lying position. This is then repeated for one or more lying positions. When the desired number of lying positions has been stored, the user leaves the parameter setting mode, and enters an operative mode. Here, the control unit monitors the input from the sensors, and determines, based on the stored data related to the stored lying positions, the lying position closest resembling the one presently assumed, and controls the firmness and/or height of the zones to firmness/height levels stored for said lying position.

The sensor data for a lying position may vary slightly when obtained when the firmness/height levels of the mattress have been adjusted to comply with this lying position, and when the firmness/height levels are still adjusted to another, previously assumed lying position. However, the control unit will normally be capable of distinguishing between such lying positions anyway. However, in case a large number of lying positions have been stored, and/or if several relatively similar lying positions have been stored, the control unit may further store sensor data for a lying position both when the mattress is set to this lying position, and when it is set to other lying positions. For example, it is possible to store sensor data for every predefined lying position for every firmness/height value setting corresponding to these predefined lying positions. Thus, if three lying positions a, b and c have been defined, and corresponding to firmness/height settings A, B and C, respectively, sensor data for distinguishing between different lying positions may be stored for lying positions a, b and c using firmness/height setting A; for a, b and c using firmness/height setting B; and for a, b and c using firmness/height setting C. Hereby, distinguishing between different lying positions becomes more accurate. Additionally or alternatively, fewer and less sensitive sensors may be used.

The control unit may be arranged to determine, based on input from said sensors, the present lying position of a user continuously or regularly. For example, the control unit may continuously monitor the sensor data, and evaluate whether a change in lying position has occurred, or do such evaluation regularly, such as every 15 or 30 seconds, every minute, or the like. However, alternatively or additionally, the control unit may be adapted to determine, based on input from said sensors, the present lying position of a user when it is determined that a sensor input from any of the sensors is changed compared to a last stored sensor value from said sensor by a magnitude exceeding a predefined threshold value.

The control unit may further be arranged to log and store data from the sensors. Hereby, the raw data from the sensors may be stored, and/or the aggregated data provided by the controller based on this sensor data may be logged. For example, any determined change of lying position may be logged. The stored data may then be used to evaluate the sleep of a user, e.g. with a physician, a sleeping coach, or the like. From analysis of such sleep data, it is possible to determine various sleeping problems, and possible to provide remedies which may improve both quantity and quality of sleep.

When the control unit has determined that a new lying position has been assumed by the user, it may preferably be arranged to wait a certain time, such as a few seconds, before adapting the firmness/height to the new lying position. For example, the control unit may use a wait time in the range 1-60 seconds, and preferably 5-30 seconds, and most preferably 10-20 seconds before responding. Hereby, unnecessary firmness/height variations are avoided, e.g. when a user for a short while assumes a new lying position but then returns to the previous lying position again, when a user assumes an intermediate lying position for a short while before assuming an intended new lying position, and the like. Thus, too frequent alteration of the firmness/height is avoided, whereby the transitions become smoother and less noticeable.

Figure 5A:
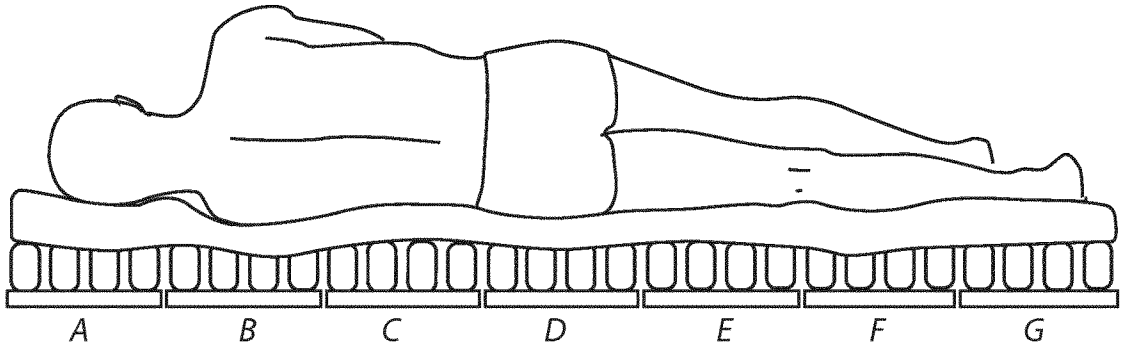
FIGS. 5*a-c* show a mattress having seven zones when used in a side position, a prone position and a supine position, respectively.
Figure 5B:
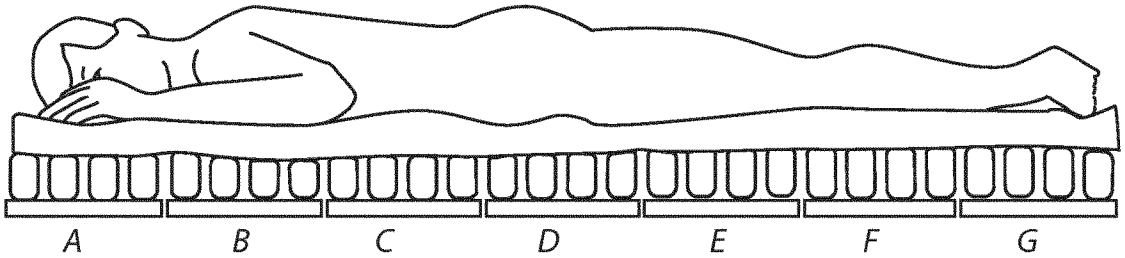
Figure 5C:
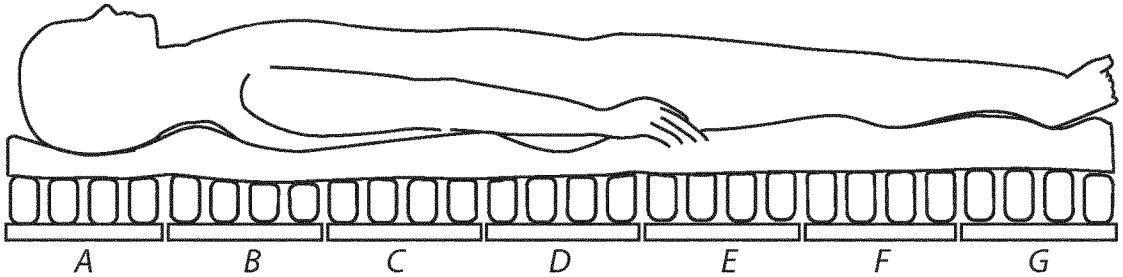

With reference to FIGS. 5*a-c*, a seven zone mattress is shown when used in a side position, a prone position and a supine position, respectively. In the following, reference is only made to firmness. However, it should be appreciated by the skilled reader that corresponding effects may be obtained by height variations, as will be discussed in more detail in the following. Thus, increased firmness corresponds to increased height, and vice versa. In a side position, as shown in FIG. 5*a*, the shoulders exert the greatest pressure on the mattress, and a relatively high pressure is also exerted by the pelvis. A commonly preferred firmness setting for the zones is to have a relatively firm head/neck zone, a relatively soft shoulder/upper back zone, a relatively soft lumbar zone, a relatively soft buttock/pelvis zone, a relatively firm thigh/knee zone, a relatively firm calf/lower leg zone and a relatively soft foot/ankle zone. In a prone position, as shown in FIG. 5*b*, the head exert the greatest pressure on the mattress, but overall a relatively even pressure distribution is provided. A commonly preferred firmness setting for the zones is to have a relatively soft head/neck zone, a relatively firm shoulder/upper back zone, a relatively firm lumbar zone, a relatively firm buttock/pelvis zone, a relatively firm thigh/knee zone, a relatively soft calf/lower leg zone and a relatively soft foot/ankle zone. In a supine position, as shown in FIG. 5*c*, the head and buttocks provide the greatest pressure on the mattress, but a great pressure is also exerted by the shoulders. A commonly preferred firmness setting for the zones is to have a relatively soft head/neck zone, a relatively soft shoulder/upper back zone, a relatively firm lumbar zone, a relatively soft buttock/pelvis zone, a relatively firm thigh/knee zone, a relatively soft calf/lower leg zone and a relatively soft foot/ankle zone.

In FIGS. 5*a*-*c*, the seven zones are denominated A-G, starting from the head/neck zone A. In a mattress having 10 different firmness levels for each zone, 1, being the softest, and 10 being the firmest, the following firmness values may, as an example, be used for the side position (FIG. 5*a*), prone position (FIG. 5*b*) and supine position (FIG. 5*c*), respectively.

| | A | B | C | D | E | F | G |
|---|---|---|---|---|---|---|---|
| Side | 6 | 1 | 4 | 2 | 6 | 7 | 2 |
| Prone | 2 | 6 | 7 | 6 | 7 | 4 | 2 |
| Supine | 2 | 3 | 6 | 2 | 6 | 4 | 2 |

However, as discussed above, the preferred settings vary from person to person, and the above-discussed firmness settings are only provided as an example.

The mattress may be of various types, such as having inflatable elements, comprising resilient foam elements, resilient rubber, and the like. However, preferably the mattress comprises a plurality of coil springs, and preferably coil springs arranged in separate pockets of a cover material, to define a pocket spring mattress.

In a pocket mattress realization of the present mattress, each zone is preferably arranged as a separate pocket mattress, assembled together. However, a continuous pocket mattress extending over several, or all, of the zones is also feasible. Each pocket mattress preferably comprises a plurality of strings interconnected side by side by means of a surface attachment, such as adhesive, welding, Velcro or the like. Each string comprises a plurality of continuous casings/pockets, formed by a continuous material and separated from each other by means of transverse seams, such as welded seams. Each casing/pocket contains at least one, and preferably only one, helical coil spring. The springs may have a spiral turn with a diameter of approximately 2 to 10 cm, and preferably 6 cm.

However, as discussed above, other types of mattresses are also possible to use in the above-discussed bed arrangement.

Variation of firmness and/or height in such mattresses may be achieved in various ways, as is per se previously known. Some examples of such arrangements will be discussed briefly in the following.

Figure 6A:
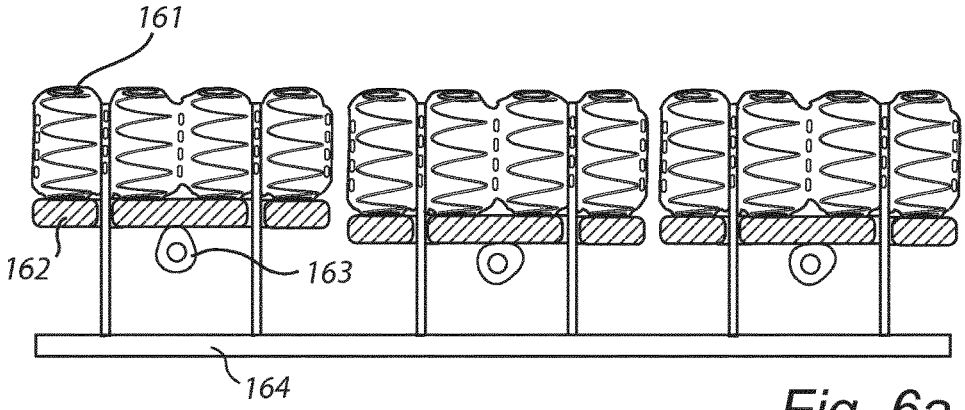
FIG. 6*a* shows a firmness adjustment arrangement according to a first embodiment.

With reference to FIG. 6*a*, zones having variable firmness may be realized by arranging coil springs 161, e.g. arranged in pockets, on support plates 162 having variable height. The height of the support plates may be controlled by rotatable elements 163 arranged under the support plates, and having an off-centre rotation axis. Hereby, by rotation of the rotatable elements, the plates assume various height positions. The upper surface of the mattress may be attached to a base 164 of the bed arrangement, whereby the height difference of the support plates provides various degrees of pre-tensioning in the mattress elements. Such firmness adjustment means are e.g. discussed in U.S. Pat. No. 3,340,548 and US 2011/0258772, both said documents hereby being incorporated by reference.

Figure 6B:
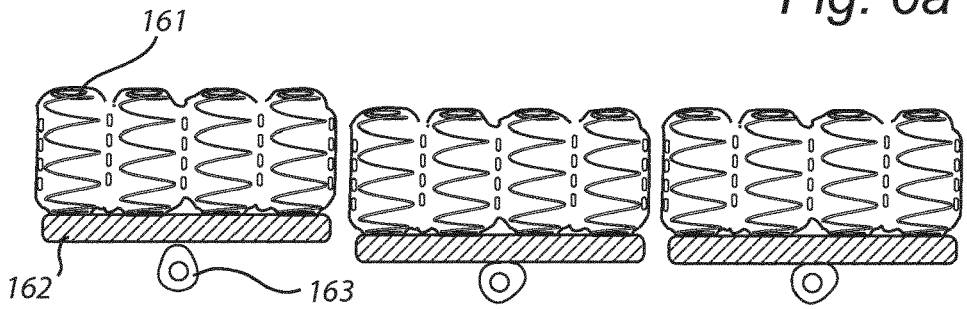
FIG. 6*b* shows a height adjustment arrangement according to a first embodiment.

As is illustrated in FIG. 6*b*, a similar arrangement may be used for variation of the height of the zones. In this embodiment, there is no attachment between the base 164 and upper surface of the mattress. Thus, the height difference of the support plates provides corresponding height differences at the surface of the mattress. Variation of firmness is often preferred, since the mattress surface will hereby only maintain a smooth and planar upper surface, which is in most cases considered more appealing. However, the supportive effect on the user is more or less the same, regardless of whether the firmness or the height of the zone(s) is varied. Furthermore, height variations are often easier and less costly to implement.

Further, it is also possible to vary both firmness and height simultaneously, e.g. by partly restricting displacement of the upper surface of the mattress.

Figure 7A:
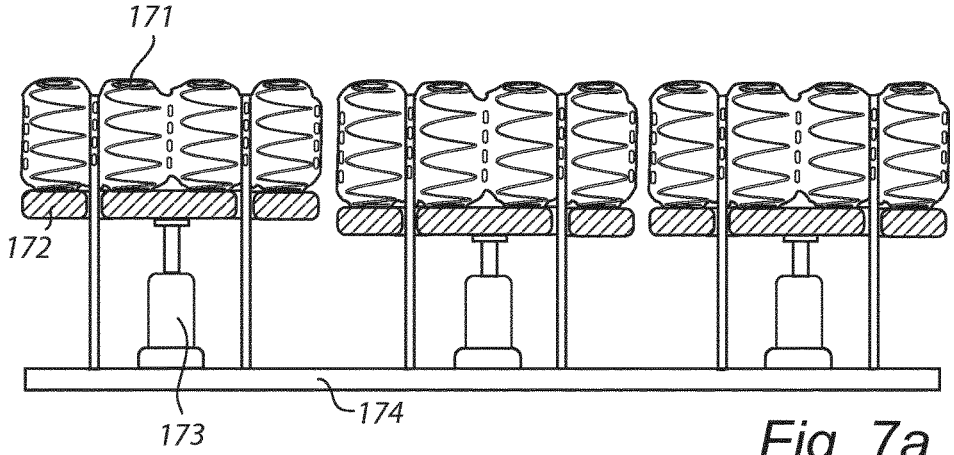
FIGS. 7*a* and 7*b* show a firmness adjustment arrangement according to a second and fourth embodiment, respectively.

With reference to FIG. 7*a*, zones having variable firmness may again be realized by arranging coil springs 171, e.g. arranged in pockets, on support plates 172 having variable height. The height of the support plates may be controlled by displacement members in the form of linear motors, jacks, and other types of lifting mechanism. Again, the upper surface of the mattress may be attached to a base 174 of the bed arrangement, whereby the height difference of the support plates provides various degrees of pre-tensioning in the mattress elements. Such firmness adjustment means are e.g. discussed in AU 55 13 00, U.S. Pat. No. 4,222,137, US 2006/0253994, WO 99/65366 and EP 2 245 967, all said documents hereby being incorporated by reference. Similar to the discussion above in relation to FIGS. 6*a* and 6*b*, the arrangement in FIG. 7*a* may also be used without attachment to the base, to provide a height variation rather than a firmness variation.

Figure 8:
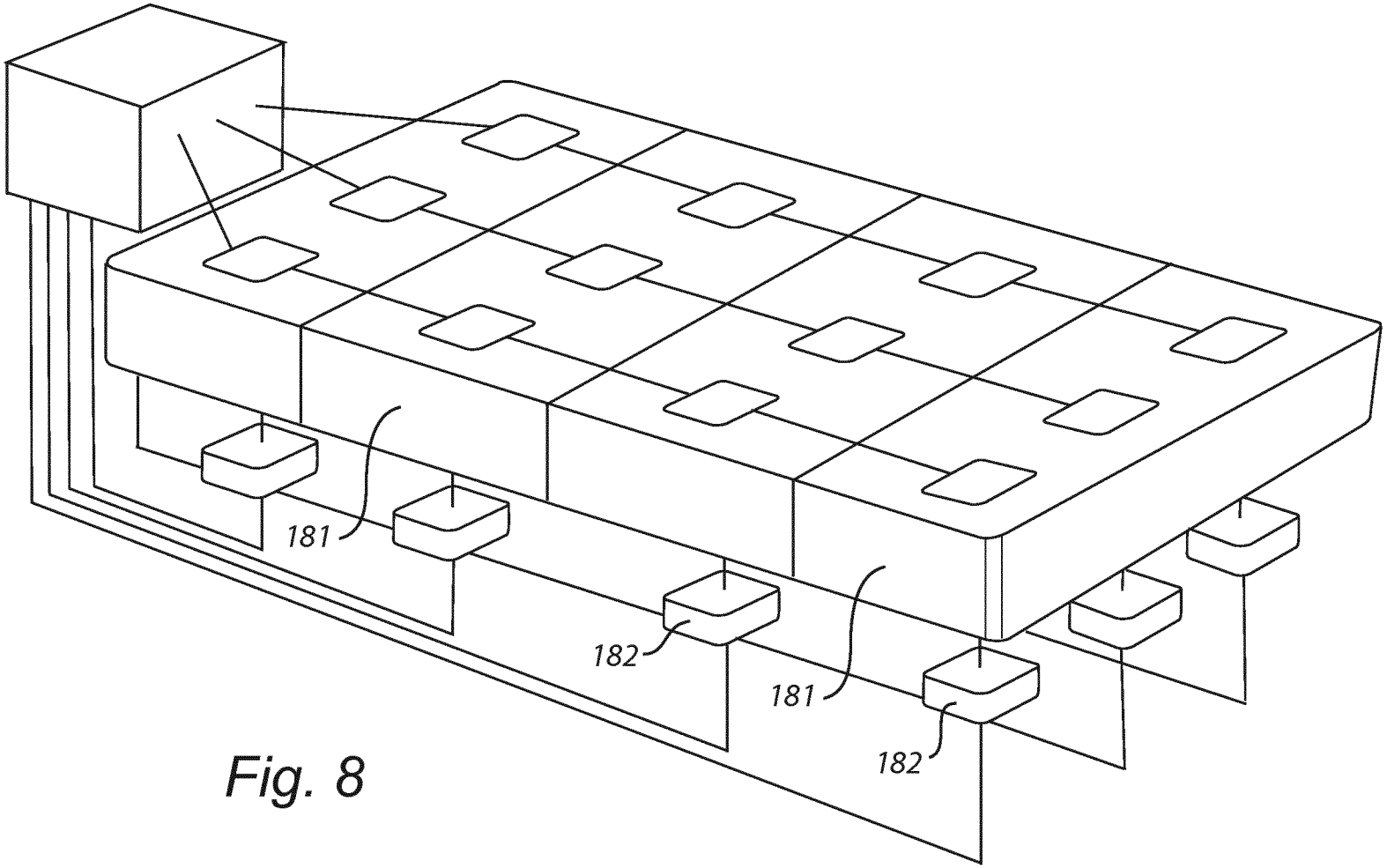
FIG. 8 shows a firmness adjustment arrangement according to a third embodiment.

With reference to FIG. 8, zones having variable firmness/height may be realized by inflatable elements 181, in which the pressure is independently variable by means of pressurization means 182. Such firmness adjustment means are e.g. discussed in WO 2009/120270, said document hereby being incorporated by reference.

Figure 7B:
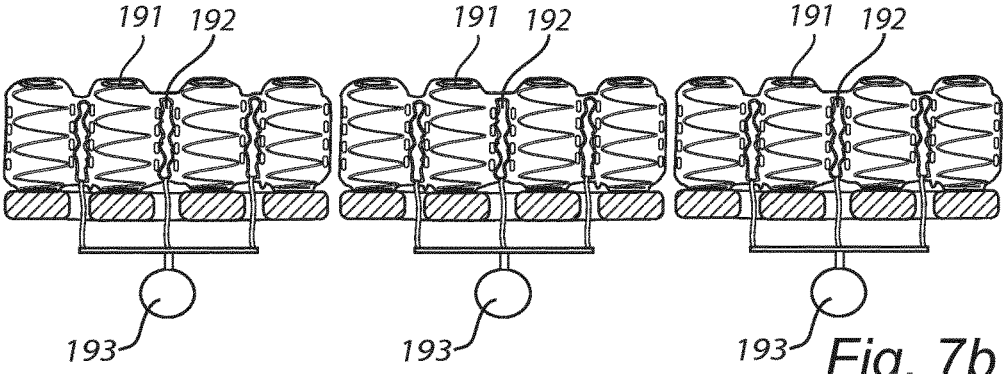

With reference to FIG. 7*b*, zones having variable firmness may be realized by a combination of inflatable elements 192 and other resilient elements, such as coil springs, e.g. arrange in pockets. The pressure in the inflatable elements is independently variable by means of pressurization means 193. Such firmness adjustment means are e.g. discussed in U.S. Pat. No. 5,113,539, said document hereby being incorporated by reference.

May other firmness and/or height adjustment means are also feasible, such as by arranging threads or strips through the mattress, whereby the height position and/or tension is variable, such as is e.g. discussed in U.S. Pat. No. 4,667,357, said document hereby being incorporated by reference.

The firmness/height adjustment means are preferably operable by a drive unit, such as a drive motor, electrically and/or pneumatically controlling the firmness/height of the various zones of the mattress.

For automatic alteration of the firmness/height of one or several zones, the control unit may vary the firmness/height until a predetermined sensor value is obtained, which corresponds to the desired firmness. However, preferably the firmness is controlled by assuming a position which has been stored during set-up or in the parameter setting mode. Thus, a displaceable part may be displaced until a desired position or height has been assumed, or the like. Alternatively, a drive unit may be controlled to provide a certain number of revolutions or rotations, or the like. It is also possible to use pulse counters or the like.

The person skilled in the art realizes that the present invention by no means is limited to the preferred embodiments described above. On the contrary, many modifications and variations are possible within the scope of the appended claims. For instance, alternative mattress elements are possible to use in the zones, such as resilient elements formed by foam, rubber, coil springs, pocketed coil springs, inflatable elements, and the like. Further, the sensors may be realized in various ways, and the control unit may be set up in various ways.

The invention claimed is:

1. A bed arrangement including adaptive properties, the bed arrangement comprising:

a mattress including a plurality of coil springs arranged in pockets to define a pocket spring mattress, and including at least one zone including at least one of firmness and height which is independently adjustable;

a drive unit arranged to adjust the at least one of firmness and height of said at least one zone;

at least one sensor, said at least one sensor being adapted to measure a physical parameter, relatable to a lying position used by a user; and a control unit arranged to determine, based on input from said at least one sensor, a present lying position of a user, said lying position being determinable to be one of a set of at least two lying positions, and to control the drive unit to adjust the at least one of firmness and height of said at least one zone to preset at least one value of at least one of firmness and height corresponding to the determined lying position, wherein the control unit is configured to continuously determine, based on input from the at least one sensor, the present lying position of the user, and to wait a predetermined period of time after having determined that a new lying position has been assumed by the user before adapting the firmness to the new lying position, wherein the at least one sensor includes at least two sensors and wherein the at least two sensors are arranged in a flexible and planar sensor envelope arranged on top of the mattress.

2. The bed arrangement of claim 1, wherein the mattress comprises at least two zones including at least one of firmness and height which is independently adjustable.

3. The bed arrangement of claim 2, wherein the at least two zones, including at least one of firmness and height which is independently adjustable, extend over essentially the whole width of the mattress, the at least two zones being separated in a longitudinal direction of the mattress.

4. The bed arrangement of claim 1, wherein the at least one zone, including at least one of firmness and height which is independently adjustable, extends over essentially the whole width of the mattress.

5. The bed arrangement of claim 1, wherein the set of lying positions comprises at least two lying positions.

6. The bed arrangement of claim 5, wherein the set of lying positions comprises at least three lying positions corresponding to the user lying on the back, on the stomach and on a side.

7. The bed arrangement of claim 1, wherein the sensor envelope has an electrical impedance characteristic that varies with a normal force exerted thereon.

8. The bed arrangement of claim 1, wherein the sensor envelope includes an upper flexible electrically conductive sheet comprising an upper sensor conductor, a lower flexible electrically conductive sheet including a lower sensor conductor, and a flexible intermediate layer including an active sensor region which has an electrical impedance characteristic that varies with a normal force exerted thereon, said intermediate layer being located between said upper and lower conductive sheets.

9. The bed arrangement of claim 1, wherein the control unit is operable in a parameter setting mode, in which the preset at least one value of at least one of firmness and height for different zones in different lying positions are at least one of definable and adjustable.

10. The bed arrangement of claim 9, wherein in the parameter setting mode, the set of lying positions is at least one of definable and re-definable.

11. The bed arrangement of claim 10, wherein the control unit is further arranged to store, when the set of lying positions is defined or redefined, sensor data from said at least one sensor corresponding to said lying positions, and to use said stored sensor data for distinguishing between the lying positions when in an operative mode.

12. The bed arrangement of claim 1, further comprising a remote control adapted to communicate with the control unit, said communication being provided through a wireless interface.

13. The bed arrangement of claim 1, wherein the control unit is arranged to determine, based on input from said sensors, the present lying position of a user when it is determined that a sensor input from any of the at least one sensor is changed compared to a last stored sensor value from said at least one sensor by a magnitude exceeding a threshold value.

14. The bed arrangement of claim 1, wherein the mattress comprises at least three zones including at least one of firmness and height which is independently adjustable.

15. The bed arrangement of claim 1, wherein the mattress comprises at least five zones including at least one of firmness and height which is independently adjustable.

16. The bed arrangement of claim 15, wherein the at least five zones, including at least one of firmness and height which is independently adjustable, extend over essentially the whole width of the mattress, the at least five zones being separated in a longitudinal direction of the mattress.

17. The bed arrangement of claim 1, wherein the predetermined time period to wait after having determined that the new lying position has been assumed by the user before adapting the firmness to the new lying position is in a range of 1-60 seconds.

18. A method for automatic adaptation of properties of a bed arrangement, comprising:

providing a mattress including a plurality of coil springs arranged in pockets to define a pocket spring mattress, and including at least one zone including at least one of firmness and height which is independently adjustable;

providing at least two sensors in a flexible and planar sensor envelope arranged on top of the mattress, said at least two sensors being adapted to measure a physical parameter which is relatable to a lying position used by a user;

determining, based on input from said at least two sensors, a present lying position of a user, said lying position being determinable to be one of a set of at least two lying positions;

adjusting at least one of the firmness and height of said at least one zone to preset at least one value of at least one of firmness and height corresponding to the determined lying position; and continuously determining, based on input from the at least two sensors, the present lying position of the user, and waiting a predetermined period of time after having determined that a new lying position has been assumed by the user before adjusting the firmness to the new lying position.

19. A bed arrangement including adaptive properties, comprising:

a mattress including at least one zone including at least one of firmness and height which is independently adjustable;

a drive unit arranged to adjust the at least one of firmness and height of said at least one zone;

at least one sensor, said at least one sensor being adapted to measure a physical parameter, relatable to a lying position used by a user; and a control unit arranged to determine, based on input from said at least one sensor, a present lying position of a user, said lying position being determinable to be one of a set of at least two lying positions, and to control the drive unit to adjust the at least one of firmness and height of said at least one zone to preset at least one value of at least one of firmness and height corresponding to the determined lying position, wherein the at least one sensor includes at least two sensors and wherein the at least two sensors are arranged in a flexible and planar sensor envelope arranged on top of the mattress, and wherein the sensor envelope includes an upper flexible electrically conductive sheet comprising an upper sensor conductor, a lower flexible electrically conductive sheet including a lower sensor conductor, and a flexible intermediate layer including an active sensor region which has an electrical impedance characteristic that varies with a normal force exerted thereon, said intermediate layer being located between said upper and lower conductive sheets.

* * * * *